United States Patent [19]

Hänsch

[11] Patent Number: 4,684,116

[45] Date of Patent: Aug. 4, 1987

[54] METHOD AND APPARATUS FOR COLLATING FOLDED PRINTED SIGNATURES USING CONVEYORS ROTATING ABOUT A CENTRAL AXIS

[75] Inventor: Egon Hänsch, Wetzikon, Switzerland

[73] Assignee: Ferag AG, Hinwil, Switzerland

[21] Appl. No.: 877,359

[22] Filed: Jun. 23, 1986

[30] Foreign Application Priority Data

Jul. 1, 1985 [CH] Switzerland ..... 2828/85

[51] Int. Cl.[4] ..... B65H 39/02

[52] U.S. Cl. ..... 270/54; 271/9; 271/69; 271/204; 271/277; 198/644; 198/408; 198/456; 198/458; 270/55

[58] Field of Search ..... 270/53–58; 271/9, 69, 182, 270, 277, 271, 202, 204, 206; 198/644, 408, 456, 458

[56] References Cited

U.S. PATENT DOCUMENTS

| | | | |
|---|---|---|---|
| 2,626,074 | 1/1953 | Vogt | 270/55 |
| 2,969,981 | 1/1961 | Faeber | 270/54 |
| 3,481,594 | 12/1969 | McCain et al. | 270/54 |
| 3,540,721 | 11/1970 | Blowsky | 270/58 |
| 4,058,202 | 11/1977 | Reist et al. | 270/55 |
| 4,398,710 | 8/1983 | Hansch | 270/55 |

FOREIGN PATENT DOCUMENTS

| | | | |
|---|---|---|---|
| 0095603 | 12/1983 | European Pat. Off. . | |
| 2447336 | 10/1974 | Fed. Rep. of Germany | 270/58 |
| 2512017 | 3/1975 | Fed. Rep. of Germany | 270/55 |
| 417647 | 7/1966 | Switzerland . | |
| 2072631 | 10/1981 | United Kingdom | 270/54 |

*Primary Examiner*—E. H. Eickholt

*Attorney, Agent, or Firm*—Werner W. Kleeman

[57] ABSTRACT

Collation of folded printed signatures or sheets is accomplished by a rotating collating cylinder or rotary collator which is rotatably driven about its longitudinal axis of revolution. The rotary collator comprises a plurality of collating conveyors arranged substantially parallel to this longitudinal axis. These collating conveyors are substantially annularly positioned about this longitudinal axis and extend substantially parallel to the longitudinal axis of the rotary collator. The folded printed signatures or sheets are fed or conveyed by three feeding conveyors or infeed devices and are deposited to straddle the collating conveyors or the respective folded printed signatures or sheets already straddling the collating conveyors. The folded printed signatures or sheets are displaced in the direction of conveyance of the rotary collator while revolving about the longitudinal axis of the rotary collator. The printed signatures or sheets are thus conveyed along a path which has the shape of a helix or coiled spiral. The end products are gripped at a product withdrawal location by a withdrawal conveyor or device and conveyed to a different location.

25 Claims, 7 Drawing Figures

METHOD AND APPARATUS FOR COLLATING FOLDED PRINTED SIGNATURES USING CONVEYORS ROTATING ABOUT A CENTRAL AXIS

CROSS REFERENCE TO RELATED APPLICATION

The present invention is related to the commonly assigned U.S. patent application Ser. No 877,360, filed, June 23, 1986, and entitled "Method and Apparatus for Opening Printed Products Which Have Been Folded Off-Center", the disclosure of which is incorporated herein by reference.

This present invention is also related to the commonly assigned U.S. patent application Ser. No. 889,221, filed July 25, 1986, and entitled "Apparatus for Collating Folded Printed Products, especially Signatures on Sheets", the disclosure of which is incorporated herein by reference.

BACKGROUND OF THE INVENTION

The present invention broadly relates to an improved method as well as an improved apparatus for collating folded printed products, especially signatures or sheets.

Generally speaking, the method of the present invention is for collating folded printed signatures or sheets in which the folded printed signatures or sheets are conveyed along a substantially straight, moving conveyor path and are thereby deposited over one another in a straddling manner.

In other words, the method of the present invention is for collating folded printed products especially signatures or sheets, and comprises the steps of conveying the folded printed signatures or sheets in a forward conveying movement and in straddlingly overlapping relationship along a plurality of substantially straight conveyor paths and positioned radially around the conveyor paths.

In its apparative aspects, the present invention concerns an apparatus for collating folded printed products, especially signatures or sheets, in which the folded printed signatures or sheets are conveyed by means of a collating conveyor along a substantially straight, moving conveyor path and are thereby deposited over one another in a straddling manner.

In other words, the apparatus of the present invention is for collating folded printed products, especially signatures or sheets, and comprises a plurality of collating conveyors for conveying the folded printed signatures or sheets along a substantially straight conveyor path in mutual straddling relationship.

Known apparatuses for collating printed signatures, as described, for example, in the Swiss Patent No. 412,795, have a plurality of deposit stations arranged along a collating conveyor. The folded printed signatures are removed from a stack, opened and deposited in a straddling manner on the collating conveyor or on the respective folded printed signatures which is already present on the collating conveyor at this location. Since the folded printed signatures each must be individually removed from a stack, it is not possible to arbitrarily increase the operational speed of such apparatuses. Furthermore, the folded printed signatures which as a rule leave the rotary printing press in an imbricated formation must first be formed into a stack which then must be brought to the deposit stations. This requires, however a significant expenditure of time, infrastructure, equipment and/or manpower.

These disadvantages are substantially eliminated by an apparatus known from the European Patent Publication No. 0,095,603, published Dec. 7, 1983, and corresponding to the U.S. Pat. No. 4,489,930, granted Dec. 25 1984. In this known apparatus, the folded printed products are fed continuously, i.e. directly in the arriving formation to the collating conveyor. By this means the folded printed products no longer, as previously was the case, have to be stacked up into a stack. This apparatus, however, has the disadvantage of a relatively large structured length since the feeders have the same feeding direction as the collating conveyors at least in the transfer region of the folded printed signatures or sheets. Moreover, it is not possible to increase the operational speed in the amount desired.

SUMMARY OF THE INVENTION

Therefore, with the foregoing in mind, it is a primary object of the present invention to provide a new and improved method and apparatus for collating folded printed products, especially signatures or sheets, which do not exhibit the aforementioned drawbacks and shortcomings of the prior art constructions.

Another and more specific object of the present invention aims at providing a new and improved method and apparatus of the previously mentioned type which permit a collation of folded printed products, especially signatures or sheets in the smallest possible space with a higher speed of operation than has been hitherto possible.

Yet a further significant object of the present invention aims at providing a new and improved apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the method of the present invention for collating folded printed products, especially signatures or sheets, is manifested by the features that a plurality of collating conveyors are provided which are substantially parallel to a common axis of revolution and which collating conveyors are positioned around this axis of revolution. The folded printed signatures or sheets rotate about this axis of revolution during their conveyance along the associated collating conveyor.

In other words, the method of the present invention is manifested by the features that it comprises the steps of revolving the plurality of substantially parallel conveyor paths about a common axis of revolution together with the folded printed products during the forward conveying movement along the conveyor paths.

The apparatus of the present invention for collating folded printed products, especially signatures or sheets is manifested by the features that a plurality of collating conveyors are provided having a direction of conveyance which is substantially parallel to a common axis of revolution. These collating conveyors are positioned around this axis of revolution and are revolvingly driven about the aforementioned axis of revolution during the conveyance of the folded printed signatures or sheets.

In other words, the apparatus of the present invention is manifested by the features that each collating conveyor of the plurality of collating conveyors is arranged substantially parallel to a common axis of revolution, each collating conveyor being arranged in spaced relationship to the common axis of revolution. Rotary drive means are provided for revolving the plurality of collating conveyors about the common axis of revolution. These same rotary drive means may also simultaneously serve for driving the plurality of collating conveyors in rotation about their own axes of rotation and for transporting the folded printed signatures or sheets along these collating conveyors in a direction of conveyance extending substantially parallel to the common axis of revolution. Of course separate drives or drive means can be provided for accomplishing the variously required driving operations or functions.

Only one collating conveyor is provided in the aforesaid known apparatuses, i.e. each infeed or loading apparatus only feeds or loads one individual collating conveyor. However, the apparatus according to the invention is provided with a plurality of revolving driven collating conveyors. This means that several collating operations can be simultaneously performed. Folded printed signatures or sheets can be deposited at each loading position in rapid sequence on one of the individual collating conveyors without the necessity of correspondingly increasing the advance or feed speed of the collating conveyors. This is due to the fact that the period of a revolution of the collating conveyors about the common axis of revolution is substantially available for feeding the folded printed products. A relatively short construction or structural length in the direction of axial signature feed is possible in spite of the high efficiency since the folded printed signatures or sheets follow a path in the shape of a helix or coiled spiral.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
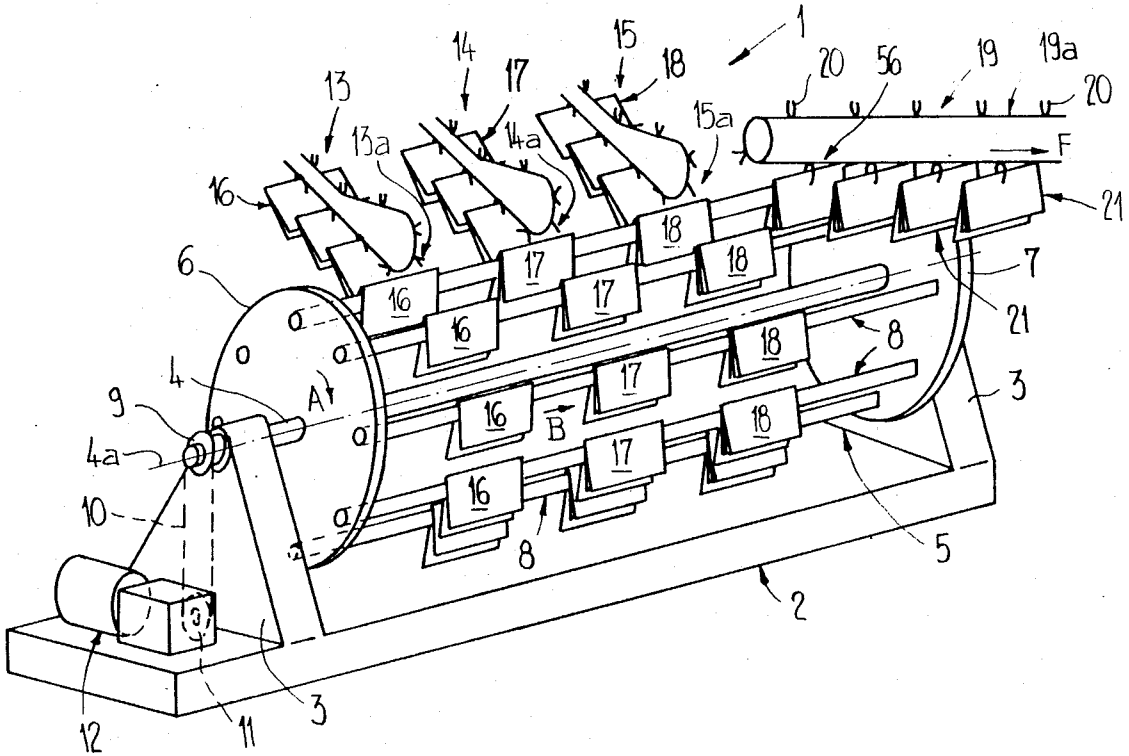
FIG. 1 is a perspective view of a preferred embodiment of the collating apparatus.

Describing now the drawings, it is to be understood that to simplify the showing thereof only enough of the structure of the apparatus for collating folded printed products, especially signatures or sheet, has been illustrated therein as is needed to enable one skilled in the art to readily understand the underlying principles and concepts of this invention. Turning now specifically to FIG. 1 of the drawings, the collating apparatus 1 illustrated therein by way of example and not limitation and employed to realize the method as hereinbefore described, will be seen to comprise a frame or stand 2 having bearing pedestals or brackets 3 in which a shaft 4 of a collating drum or cylinder 5 is positioned. Two substantially parallel, discoidal, rotatable supporting or support elements 6 and 7 are attached to the shaft 4 and mutually separated by a predetermined spacing. A plurality of collating conveyors 8, which will be further described hereinbelow, is positioned between these two rotatable supporting or support elements 6 and 7. These two rotatable support elements 6 and 7 form, together with the shaft 4, a common mounting support for the collating conveyors 8. These collating conveyors 8 are pivotably arranged in the rotatable support elements 6 and 7 as will be described hereinbelow in relation to FIGS. 3 and 4. Furthermore, the collating conveyors 8 are disposed substantially parallel to one another and to the shaft 4 of the collating drum or cylinder 5 and are substantially annularly positioned around the shaft 4.

Figure 4:
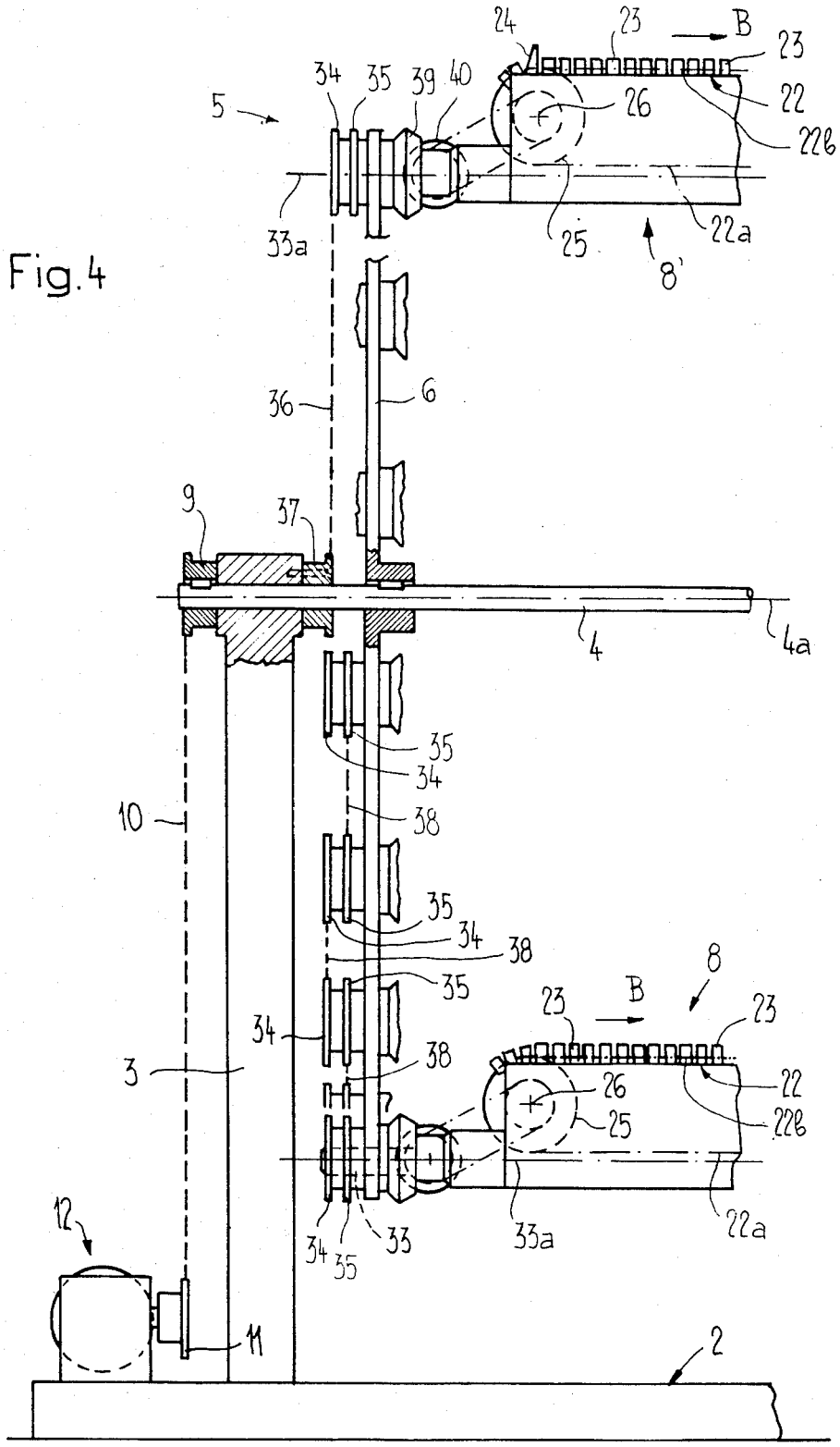
FIG. 4 is a side view of the driven end of the collating cylinder or drum shown in partial section and on an enlarged scale relative to FIG. 1.

As shown in FIGS. 1 and 4, a sprocket or sprocket wheel 9 is mounted on one end of the shaft 4. Substantially below this sprocket or sprocket wheel 9 there is situated a drive means 12 positioned on the base of the frame or stand 2. on a not particularly referenced drive shaft of this drive means 12 there is mounted a further sprocket or sprocket wheel 11 which is also positioned substantially below the sprocket or sprocket wheel 9. A chain 10 engages and travels around the periphery of these sprockets or sprocket wheels 9 and 11. The collating drum or cylinder 5 together with the collating conveyors 8 is rotationally or circularly, i.e. revolvingly, driven by means of the drive means 12 in the direction of the arrow A about an axis of revolution 4*a*.

A plurality of, for instance, three feeding conveyors or infeed devices 13, 14 and 15 for infeeding folded printed signatures or sheets 16, 17 and 18, respectively, are positioned one behind the other as seen in the direction of the longitudinal axis or axis or revolution 4*a* of the shaft 4, i.e. also as seen in a direction of conveyance B of the collating conveyors 8. The feeding conveyors or infeed devices 13, 14 and 15, whose construction will be described in more detail in conjunction with FIG. 7 hereinbelow, end or terminate in the vicinity of the outer circumference or periphery of the collating drum or cylinder 5. The region in the vicinity of the outer circumference or periphery of the collating drum or cylinder 5 located between the collating drum or cylinder 5 and the infeed devices 13, 14 and 15 defines respective transfer regions 13*a*, 14*a* and 15*a* for the folded printed signatures or sheets 16, 17 and 18, respectively. When seen in the direction of conveyance B of the collating conveyors 8 there is positioned behind the last infeed device 15 a schematically illustrated product withdrawal device or conveyor 19. This product withdrawal device or conveyor 19 comprises grippers or clamps 20 positioned with substantially equal mutual spacing or separation along a circulatingly driven traction member 19*a* such as a belt or chain. These grippers or clamps 20 grip end products 21 comprising a plurality of overlapping or interstuffed folded printed signatures or sheets, lift or raise these folded printed end products 21 from the collating conveyors 8 and convey or transport them to a further conventional processing station which is not here particularly shown in FIG. 1 since it does not constitute subject matter of the present invention.

The design of the collating drum or cylinder 5 will be described in more detail hereinbelow using FIGS. 3 to 6.

Figure 6:
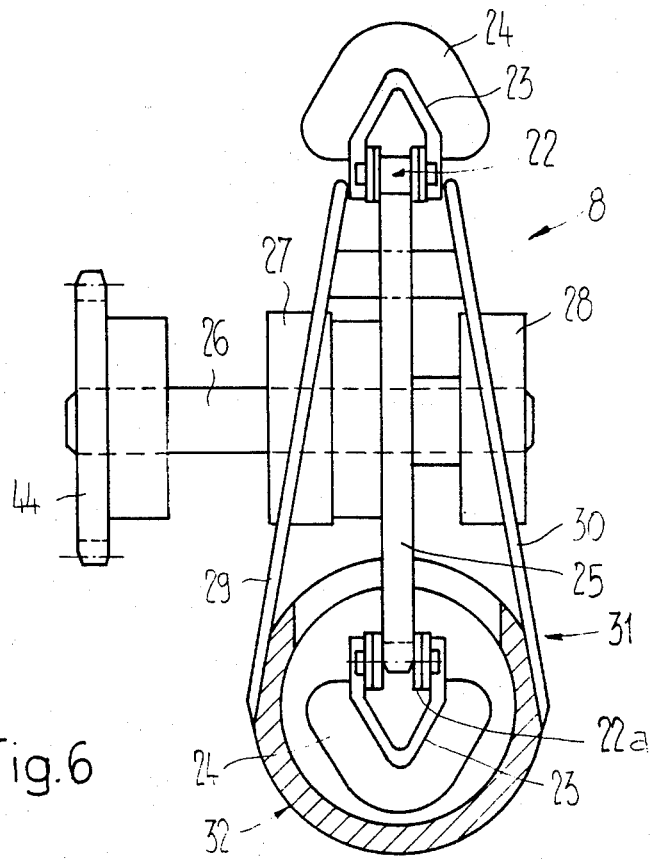
FIG. 6 is a section of the collating conveyor taken substantially along the line VI—VI in FIG. 5.
Figure 5:
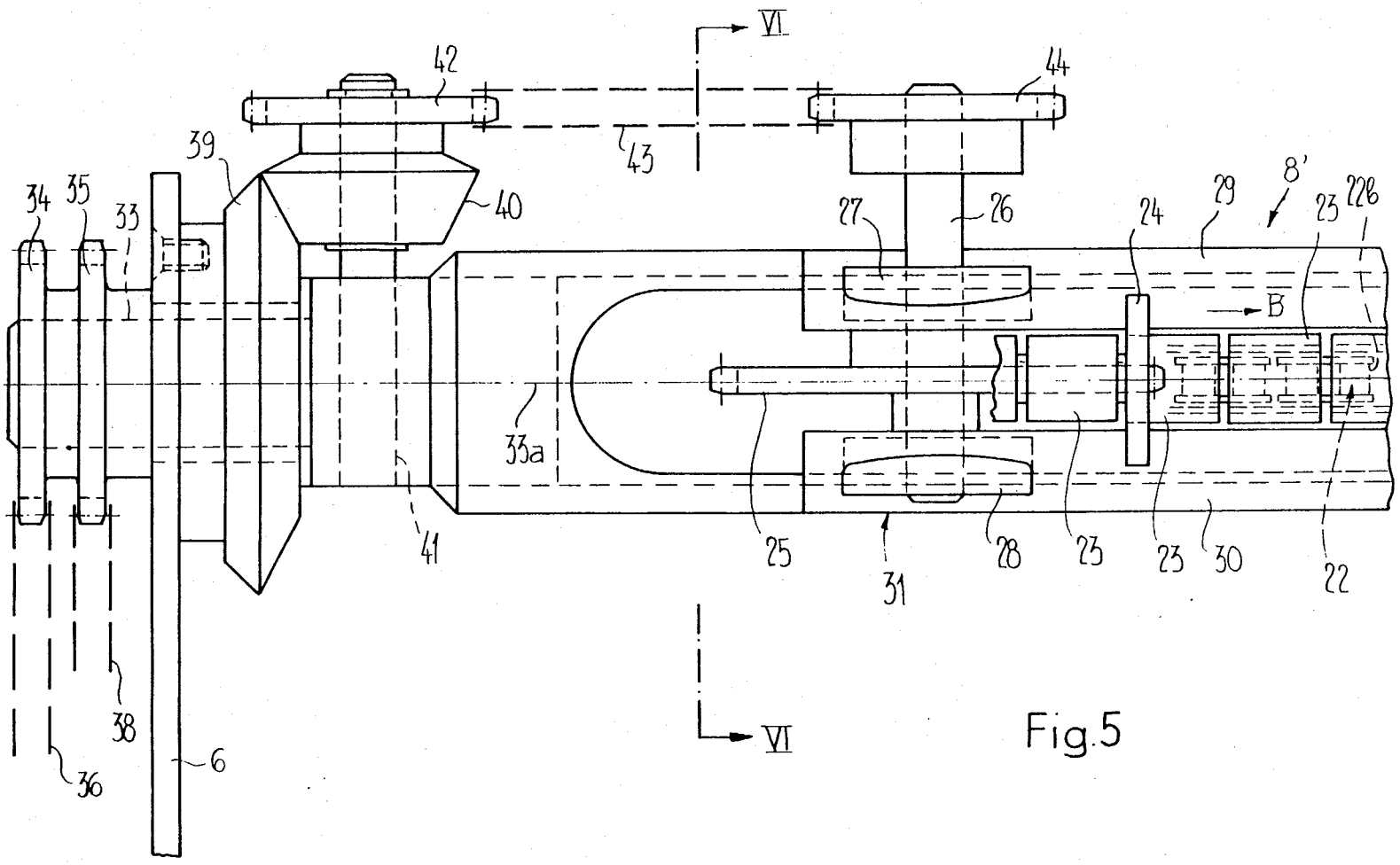
FIG. 5 is a top plan view of the driven end of a collating conveyor on an enlarged scale relative to FIGS. 1 and 4.

Turning first to FIG. 6, it can be seen that each collating conveyor 8 comprises an endless circulatingly driven chain 22. This chain 22 possesses support or rest members 23 in the shape of a peaked roof which are provided for the printed signatures or sheets 16, 17 and 18. Entrainment means 24 are also attached to this chain 22 and are spaced at substantially equal intervals. These entrainment means 24 engage the rear or trailing edges of the printed signatures or sheets 16, 17 and 18 as seen in the direction of conveyance B of the collating conveyors 8 and serve to substantially align the edges of the overlapping printed signatures or sheets 16, 17 and 18 over one another. The chain 22 travels around two sprockets or sprocket wheels of which only one driven sprocket or sprocket wheel 25 is shown in FIGS. 4 to 6. This driven sprocket or sprocket wheel 25 is mounted on a shaft 26. This shaft 26 is rotatably mounted in bearings 27 and 28. These bearings 27 and 28 are positioned in upwardly converging side surfaces or walls 29 and 30 of a carrying or support casing or housing 31 as shown in FIGS. 5 and 6. This carrying or support casing 31 comprises furthermore a support tube 32 (cf. FIG. 6) extending in the direction of conveyance or axial signature feed B. The support casing 31 is connected with the side surfaces or walls 29 and 30. A return run 22*a* of the chain 22 travels through this support tube 32.

Figure 3:
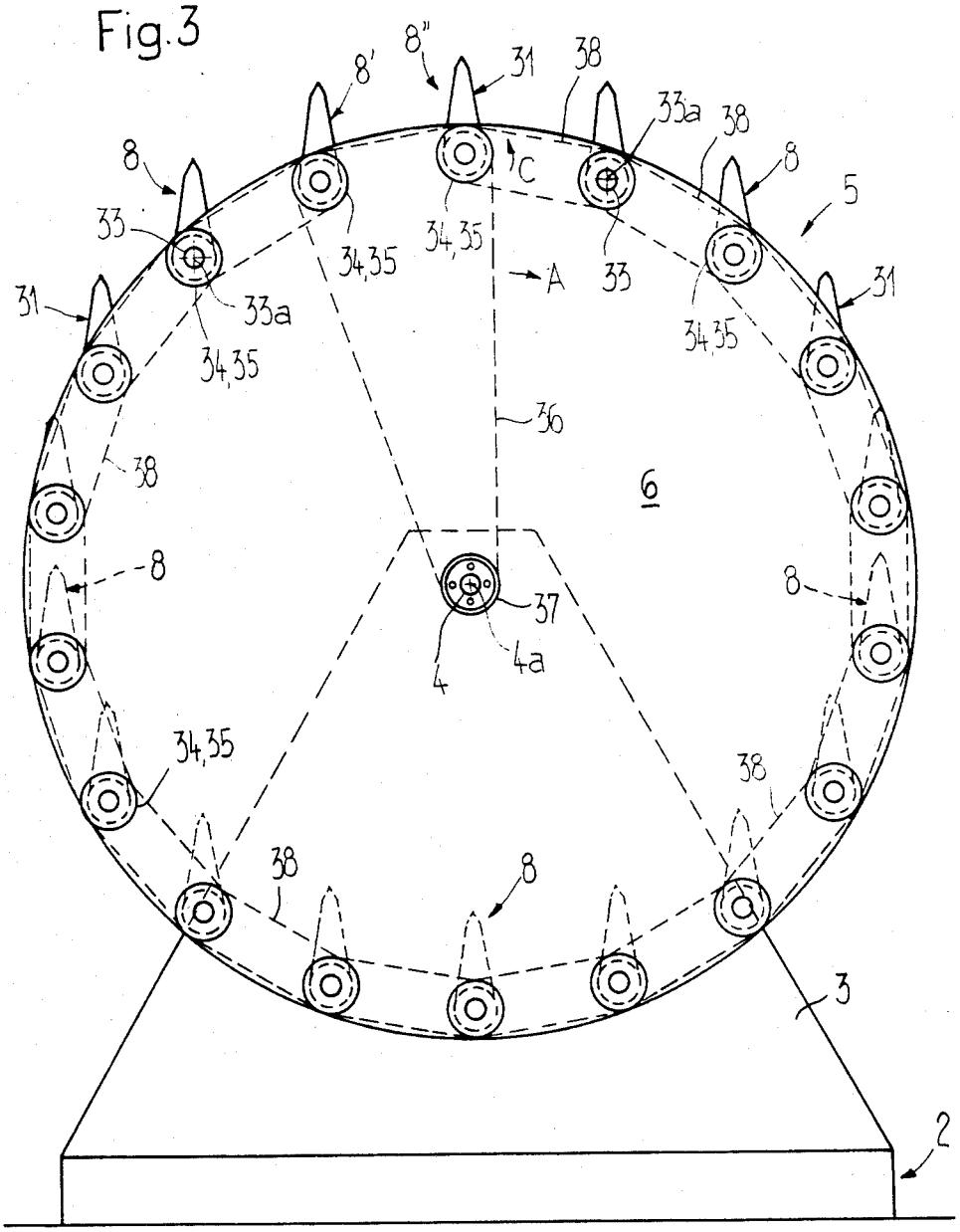
FIG. 3 is an end view of the collating cylinder or drum shown on an enlarged scale relative to FIG. 1.

The carrying or support casings 31 are rotatably positioned at both ends in the rotatable support elements 6 and 7 by means of stub shafts 33 which define an axis of rotation 33*a*. As illustrated in FIGS. 3 to 5, two sprockets or sprocket wheels 34 and 35 are positioned on one end of the carrying or support casing 31 on this stub shaft 33. A drive chain 36 travels over the sprockets or sprocket wheels 34 of both of the collating conveyors indicated by reference numerals 8' and 8'' shown in FIG. 3. This drive chain 36 is further connected to a sprocket or sprocket wheel 37 which is coaxially fastened to the shaft 4 of the collating drum or cylinder 5 and is fastened on the bearing pedestal 3 as shown in FIGS. 3 and 4. Respective chains 38 engage the sprockets or sprocket wheels 35 of both of the collating conveyors 8' and 8'' and which also travel over the sprockets or sprocket wheels 35 of the adjacent collating conveyor 8 as can be especially well seen in FIG. 3.

As FIG. 3 further shows, the remaining collating conveyors 8 are connected in pairs by means of further chains 38 which travel over the sprockets or sprocket wheels 34 and 35, respectively, of the adjacent collating conveyors 8. In such manner the collating conveyors 8 are interconnected for common rotation about their axis of rotation 33*a* by means of the chains 38 and are coupled by means of the chain 36 to the stationary sprocket or sprocket wheel 37. As a result of this coupling the collating conveyors 8' and 8'' rotate about the axes 33*a* of their support casings or housing 31 during one revolution of the collating drum or cylinder 5 in the direction of the arrow A as a result of their sprockets or sprocket wheels 34 rolling along the drive chain 36 in an opposite sense, i.e. in the direction of the arrow C (cf. FIG. 3). This rotation is transferred or transmitted by means of the chains 38 to the remaining collating conveyors 8, which thus rotate in the same direction. This means that during rotation of the collating drum or cylinder 5 and thus revolution of the collating conveyors 8 about the axis 4*a*, the collating conveyors 8 substantially maintain their vertical orientation in space. The upper conveying run 22*b* of the chain 22 is thus always located on the upper side of the collating conveyors 8. The upper sides of the collating conveyors 8 thus always maintain a substantially mutually parallel relation as is illustrated in FIG. 3.

In reference to the above description, it will be appreciated that this co-rotation of the collating conveyors 8 during their revolution about the axis of revolution 4*a* can also be achieved in a different manner than in the manner described above. An example of such a different manner is described in the German Patent No. 1,224,329, published Sept. 8, 1966 and German Patent No. 1,264,454, published Mar. 28, 1968.

The drive or drive power for the sprockets or sprocket wheels 25 for the chains 22 of the collating conveyors 8 is derived from the previously described revolving motion of the collating conveyors 8 as is seen in the FIGS. 4 to 6. For this purpose a bevel gear 39 for each collating conveyor 8 is attached at the rotatable support element 6 and which engages or meshes with a second bevel gear 40 which is positioned on a shaft 41 in the carrying or support casing 31. This shaft 41 is disposed essentially perpendicular to the axis of rotation 33*a* of the collating conveyors 8. Furthermore, a sprocket or sprocket wheel 42 is fastened to this shaft 41 which is connected to an additional sprocket or sprocket wheel 44 by means of a chain 43. This sprocket or sprocket wheel 44 is located on the same shaft 26 as the sprocket or sprocket wheel 25 for the chain 22.

The sprocket or sprocket wheel 40 rolls along the stationary sprocket or sprocket wheel 39 during the previously described rotation of the collating conveyors 40 about the axes of rotation 33*a*. This results in a rotation of the sprocket or sprocket wheel 42 and thus also a rotation of the sprocket or sprocket wheel 44. The sprocket or sprocket wheel 25 and thus also the chain 22 are driven in this manner. During rotation of the collating drum or cylinder 5 there thus results a positive rotation of the chains 22 of the collating conveyors 8 in the direction of conveyance B.

It is understood that the manner of driving the chains 22 can also be accomplished in a different way than heretofore described.

Figure 7:
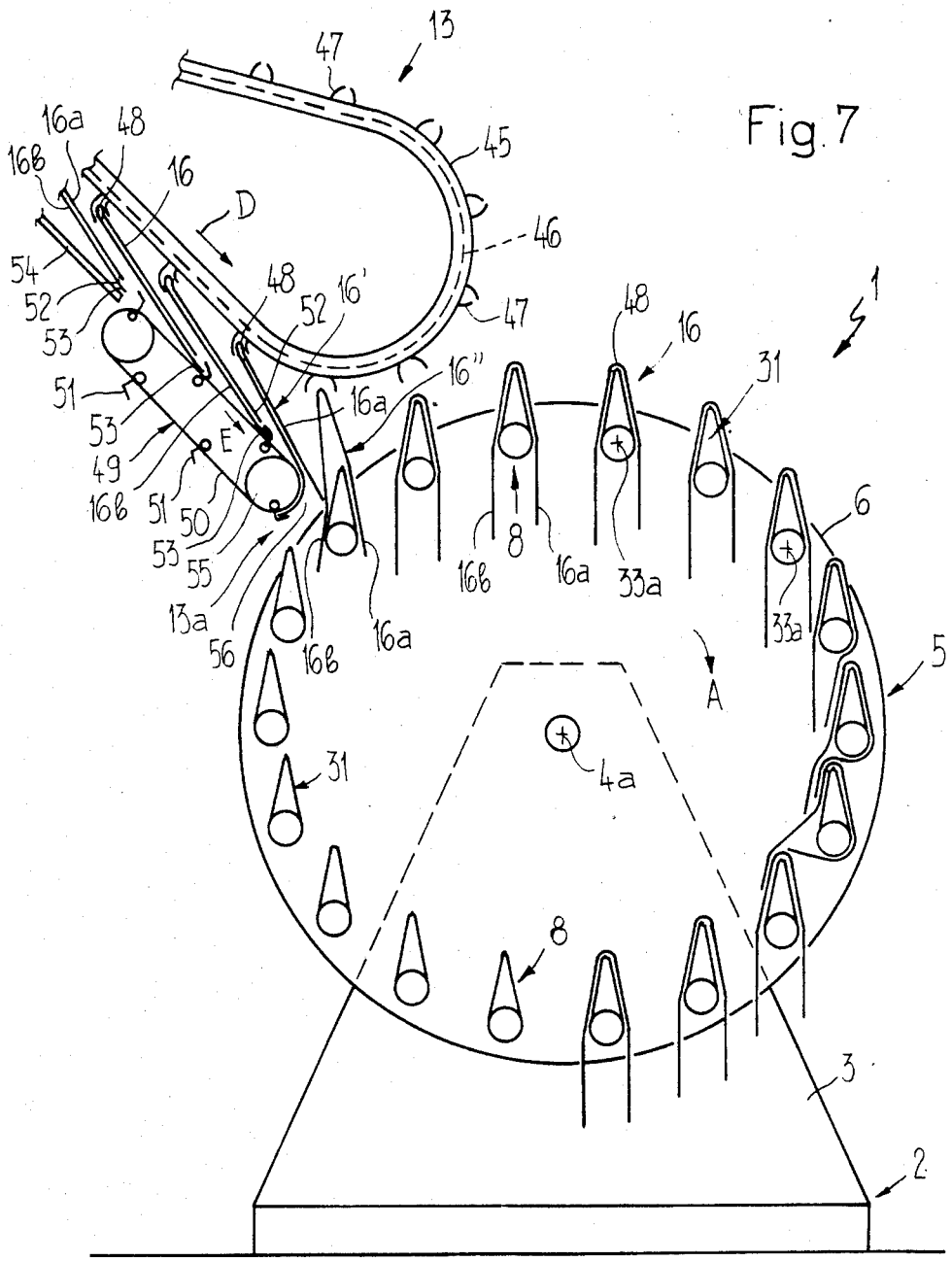
FIG. 7 shows an end view of the collating cylinder or drum and a feeding conveyor or infeed device on an enlarged scale relative to FIG. 1.

The design of the infeed devices 13, 14 and 15 and the depositing or placing of the respective delivered folded printed signatures or sheets 16, 17 and 18 onto the collating conveyors 8 is described in relation to FIG. 7 and in connection with the infeed device 13 shown therein.

Each feeding conveyor or infeed device 13, 14 and 15 comprises a traction or tension member 46 such as a belt or chain which is circulatingly driven in a channel 45. This arrangement is only schematically illustrated in FIG. 7. Grippers or clamps 47 which are controllable and are mutually separated from one another are attached to this traction or tension member 46. These grippers 47 grasp or hold the conveyed folded printed signatures or sheets 16, or the respective folded printed signatures or sheets 17 or 18, at their folded or spine edges or backbones 48. An opening or spreading device 49 is positioned below the feeding conveyor 13 and also below the other feeding conveyors 14 and 15. This opening device 49 comprises a traction or tension member 50 which is circulatingly driven in the direction of rotation E. Schematically illustrated and fastened on this traction or tension member 50 are controllable gripping members or grippers 51. These gripping members 51 are opened towards the back as seen in the direction of rotation E and serve to grip or hold the underlying portion **16*b* of the folded printed signatures or sheets 16**.

As seen in FIG. 7, the folded printed signatures or sheets 16 and in like manner the respective folded printed signatures or sheets 17 and 18 are conveyed by means of the feeding conveyor 13 (or by the respective feeding conveyors 14 and 15) such that the open or fan edge 52 of the folded printed signatures or sheets 16 which is opposite to the folded or spine edge or backbone 48 leads as seen in the direction of conveyance D of the feeding conveyor 13. The folded printed signatures or sheets 16 (and 17 and 18) are not folded in the middle but are folded off-center such that the lowermost portion **16*b* of the folded printed signatures or sheets 16 is longer than the other portion 16*a* and protrudes or extends past the other portion 16*a* at this open or fan edge 52. This leading or protruding section of the lowermost portion 16*b* of the folded printed signatures or sheets 16, the so-called marginal lap, is designated by reference numeral 53**.

The folded printed signatures or sheets 16 are conveyed by the infeed device 13 such that they come into contact with a surface or support or wall 54 at their leading open or fan edges 52. As soon as these leading open or fan edges 52 make contact in the effective region of these gripping members 51, the gripping members 51 close, thus holding the lowermost portion **16*b* of the folded printed signatures or sheets 16 by means of this protruding section or marginal lap 53**. This action is shown in FIG. 7.

The marginal lap 53 of the underlying portion **16*b* of the folded printed signatures or sheets 16 which is held by the gripping member 51 is then rotated together with the associated gripping member 51 around a front guide wheel 55 for the traction or tension member 50. This is illustrated in FIG. 7 in relation to the folded printed signature or sheet 16'. This results in the lowermost portion 16*b* of the folded printed signatures or sheets 16 being separated from the other portion 16*a* of the folded printed signature or sheet 16' at least in the region of the marginal lap 53. An opening or gap 56 is thus formed between the lowermost portion 16*b* and the other portion or section 16*a* of the folded printed signature or sheet 16'. A collating conveyor 8 now enters this opening or gap 56**.

As previously described, the collating conveyor 8 is revolvingly driven in the direction of the arrow A about the axis of revolution **4*a*. When the folded printed signature or sheet 16 has been moved by the feeding conveyor 13 in the direction of the arrow D above the collating conveyor 8 such that the collating conveyor 8 which has now arrived between the portion 16*a* and lowermost portion 16*b* of the folded printed signature or sheet 16 by its rotation in the direction A, then the associated gripper 47 is opened and the folded printed signature or sheet 16 is released as is shown in FIG. 7 in relation to the folded printed signature or sheet 16''. The folded printed signature or sheet 16'' thus straddles the collating conveyor 8 and comes to rest on the support or rest member 23 of the collating conveyor 8**.

The method of operation of the collating apparatus 1 will now be further described hereinbelow in its totality.

Figure 2:
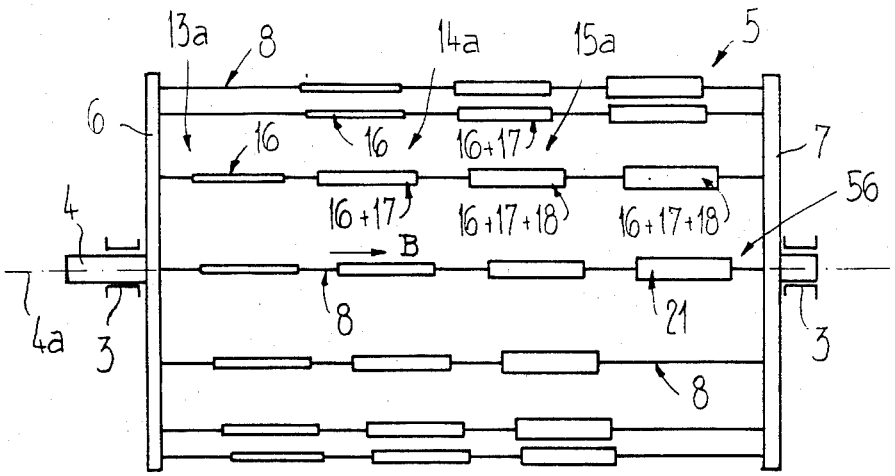
FIG. 2 is a top plan view of the collating cylinder or drum of the collating apparatus illustrated in FIG. 1.

The folded printed signatures or sheets 16 delivered by the infeed device 13 are deposited upon the collating conveyors 8 in the transfer region **13*a* as previously described. The folded printed signatures or sheets 16 come to rest in the region of their folded or spine edges or backbones 48 on the support member 23 and their portions 16*a* and 16*b* come to rest on the respective side walls 29 and 30 of the carrying or support casing 31 of each of the collating conveyors 8. As previously described the folded printed signatures or sheets 16 are conveyed in the direction of conveyance B of the collating conveyors 8 by means of the driven chain 22 of these collating conveyors 8. The folded printed signatures or sheets 16 simultaneously revolve around the axis of revolution 4*a* of the collating drum or cylinder 5 with their associated collating conveyors 8. The folded printed signatures or sheets 16** are thus conveyed along a path which is in the shape of a helix or coiled spiral as shown in FIG. 2.

After one revolution of the collating drum or cylinder 5 the folded printed product 16 is located in the transfer region **14*a* of the next infeed device 14. This infeed device 14 supplies or feeds the folded printed signatures or sheets 17 to this transfer region 14*a*. These folded printed signatures or sheets 17 are opened in the manner previously described in reference to FIG. 7 and are deposited on the folded printed products 16 possibly already resting upon the collating conveyors 8. Both superimposed folded printed products 16 and 17 are conjointly advanced or moved in the direction of conveyance B and are simultaneously revolved about the axis of revolution 4*a* of the collating drum or cylinder 5. A further folded printed signature or sheet 18 is now placed over the superimposed folded printed signatures or sheets 16 and 17 in the transfer region 15*a*. This folded printed signature or sheet 18 is fed or supplied by the infeed device 15 and is spread apart or opened in the same manner as previously described using FIG. 7. All three overlapping folded printed signatures or sheets 16, 17 and 18 form end products 21 which revolve about the axis of revolution 4*a* of the collating drum or cylinder 5 and are thus simultaneously advanced or moved forward in the direction of conveyance B. The entrainment means 24 attached to the chains 22 of the collating conveyors 8 ensure that the three overlapping folded printed signatures or sheets 16, 17 and 18** are substantially mutually aligned in superposition.

At a product removal location 56 the end products 21 are grasped by means of the grippers or clamps 20 of the withdrawal device or conveyor 19, lifted or removed from the collating conveyor 8 and conveyed away in the direction of the arrow F as is illustrated in FIG. 1. The end products 21 can thereafter be further processed by various methods. For example, these end products 21 can be fed or conveyed to a cutting device and/or a binding device or can be wound or coiled up into wound product packages in known manner.

The three superimposed folded printed signatures or sheets 16, 17 and 18 can also form only the first portion of an end product 21. The conveyor 19 of the first infeed or transfer location of the collating drum or cylinder 5 can feed these three superimposed folded printed signatures or sheets 16, 17 and 18 to a product receiving location of a collating cylinder of a further collating apparatus of the type described above. Further folded printed signatures or sheets are then deposited on top of the already superimposed folded printed signatures or sheets 16, 17 and 18 in this further collating apparatus in the manner previously described.

The collating apparatus 1 which is described above and illustrated in the FIGS. 1 through 7 can also be constructed in a different manner. In the following section only a few of the different possible variants will be briefly mentioned.

A plurality of overlapping folded printed signatures or sheets can be fed to and placed upon the collating conveyors 8 in lieu of individual folded printed signatures or sheets. The transfer regions or loading locations 13*a*, 14*a* and 15*a* can also be staggered or displaced relative to each other in the circumferential direction of the collating drum or cylinder 5. In lieu of the aforesaid continuous infeed devices or feeders 13, 14 and 15, loading apparatuses of different types can be utilized. For example, a conventional infeed device can be utilized as previously described from which the folded printed signatures or sheets are pulled or removed from a stack. The utilization or application of such feeders, however, has the disadvantage that the incoming folded printed signatures or sheets which are normally in an imbricated formation must first be formed into a stack as has been initially described.

The described and illustrated embodiments of the drive means 12 of the chains 22 belonging to the collating conveyors 8 permit a continuous forward advance or feed conveyance of the folded printed signatures or sheets 16, 17 and 18. It is conceivable to attach or build into this drive mechanism various members, for example, couplings and similar devices which permit a temporary interruption of the advance or forward movement. Such an interruption of the advance or forward movement permits processing operations to be executed, for example, the affixing of labels or the stapling or stitching or sewing together of the final folded printed products.

While there are shown and described present preferred embodiments of the invention, it is to be distinctly understood that the invention is not limited thereto, but may be otherwise variously embodied and practiced within the scope of the following claims. Accordingly,

What I claim is:

1. A method for collating folded printed products, especially signatures, comprising the steps of:

conveying the folded printed products in an advancing conveying movement and in straddlingly superimposed relationship along a plurality of substantially straight and substantially parallel conveyor paths positioned radially around a common axis of revolution; and revolving said plurality of substantially straight and substantially parallel conveyor paths about said common axis of revolution together with said folded printed products during said advancing conveying movement along respective conveyor paths of said plurality of substantially straight and substantially parallel conveyor paths.

2. The method as defined in claim 1, comprising the further steps of:

providing respective collating conveyors for defining each conveyor path of said plurality of substantially straight and substantially parallel conveyor paths;

said advancing conveying movement defining a direction of conveyance of the folded printed products; and depositing the folded printed products upon each said collating conveyor of said plurality of substantially straight and substantially parallel conveyor paths at a plurality of loading locations arranged in succession and upon respective folded printed products previously deposited on each said collating conveyor at said plurality of loading locations arranged in succession such that folded edges of the folded printed products extend substantially parallel to said direction of conveyance.

3. The method as defined in claim 2, comprising the further steps of:

feeding said folded printed products with open edges thereof located substantially opposite to said folded edges and with said open edges extending towards said plurality of loading locations; and holding and displacing a first portion of each folded printed product of said folded printed products from a second portion of each said folded printed product for opening each said folded printed product before depositing each said folded printed product upon a respective therewith associated one of said collating conveyors.

4. The method as defined in claim 2, comprising the further steps of:

feeding said folded printed products with open edges thereof located substantially opposite to said folded edges and with said open edges extending towards said plurality of loading locations;

holding and displacing a first portion of each folded printed product of said folded printed products from a second portion of each said folded printed product for opening each said folded printed product before depositing each said folded printed product upon a respective therewith associated one of said collating conveyors; and said first portion of said folded printed products comprising a lowermost portion thereof.

5. A method for collating folded printed products, especially signatures, comprising the steps of:

conveying the folded printed products in an advancing conveying movement and in straddlingly superimposed relationship along a plurality of conveyor paths positioned radially around a common axis of revolution; and revolving said plurality of conveyor paths about said common axis of revolution together with said folded printed products during said advancing conveying movement along respective conveyor paths of said plurality of conveyor paths.

6. The method as defined in clam 5, wherein:

each conveyor path of said plurality of conveyor paths extends substantially straight and substantially parallel to said common axis of revolution.

7. An apparatus for collating folded printed products, especially signatures, comprising:

a plurality of collating conveyors for conveying the folded printed products along a respective substantially straight conveyor path in straddling relationship;

each collating conveyor of said plurality of collating conveyors extending in spaced substantially parallel relationship to a common axis of revolution; and drive means for driving said plurality of collating conveyors in revolution about said common axis of revolution.

8. The apparatus as defined in claim 7, wherein:

each respective substantially straight conveyor path defines a direction of conveyance for the printed products extending substantially parallel to said common axis of revolution;

a plurality of feeder devices positioned substantially in succession in said direction of conveyance; and said plurality of feeder devices serving for depositing said folded printed products upon a respective collating conveyor of said plurality of collating conveyors and for depositing said folded printed products upon respective folded printed products previously deposited on said respective collating conveyors with folded edges thereof oriented substantially parallel to said direction of conveyance.

9. The apparatus as defined in claim 8, wherein:

each feeder device of said plurality of feeder devices has a circulatingly driven traction member;

means for circulatingly driving said plurality of feeder devices;

a plurality of grippers attached in mutual spaced relationship on said traction member; and said grippers being capable of gripping said folded printed products on said folded edge thereof.

10. The apparatus as defined in claim 8, wherein:

each feeder device of said plurality of feeder devices has a circulatingly driven traction member;

means for circulatingly driving said plurality of feeder devices;

a plurality of grippers attached in mutual spaced relationship on said traction member;

said grippers being capable of gripping said folded printed products on said folded edge thereof; and said drive means for driving said plurality of collating conveyors in revolution including said circulatingly driving means for said plurality of feeder devices.

11. The apparatus as defined in claim 8, further including:

a plurality of transfer regions located below said plurality of feeder devices;

each transfer region of said plurality of transfer regions being associated with a respective feeder device of said plurality of feeder devices;

a plurality of opening apparatuses for opening said folded printed products and located below said plurality of feeder devices; and each opening apparatus of said plurality of opening apparatuses being located in an associated transfer region of said plurality of transfer regions.

12. The apparatus as defined in claim 8, wherein:

a plurality of transfer regions located below said plurality of feeder devices;

each transfer region of said plurality of transfer regions being associated with a respective feeder device of said plurality of feeder devices;

a plurality of opening apparatuses for opening said folded printed products and located below said plurality of feeder devices;

each opening apparatus of said plurality of opening apparatuses being located in an associated transfer region of said plurality of transfer regions;

each opening apparatus of said plurality of opening apparatuses has rotary driven clamping members for grasping a portion of said folded printed product and for raising said portion relative to a further portion of said folded printed product; and a section of a path of motion of said clamping members extending substantially in said direction of conveyance of said plurality of feeder devices and approximately perpendicular to said direction of conveyance of said collating conveyors.

13. The apparatus as defined in claim 12, wherein:

a plurality of transfer regions located below said plurality of feeder devices;

each transfer region of said plurality of transfer regions being associated with a respective feeder device of said plurality of feeder devices;

a plurality of opening apparatuses for opening said folded printed products and located below said plurality of feeder devices;

each opening apparatus of said plurality of opening apparatuses being located in an associated transfer region of said plurality of transfer regions;

each opening apparatus of said plurality of opening apparatuses has rotary driven clamping members for grasping a lowermost portion of said folded printed product and for raising said portion relative to a further portion of said folded printed product; and a section of a path of motion of said clamping members extending substantially in said direction of conveyance of said plurality of feeder devices and approximately perpendicular to said direction of conveyance of said collating conveyors.

14. The apparatus as defined in claim 8, wherein:

a plurality of transfer regions located below said plurality of feeder devices;

each transfer region of said plurality of transfer regions being associated with a respective feeder device of said plurality of feeder devices;

a plurality of opening apparatuses for opening said folded printed products and located below said plurality of feeder devices;

each opening apparatus of said plurality of opening apparatuses being located in an associated transfer region of said plurality of transfer regions;

each opening apparatus of said plurality of opening apparatuses has rotary driven clamping members for grasping a lowermost portion of said folded printed product and for raising said portion relative to a further portion of said folded printed product;

a section of a path of motion of said clamping members extending substantially in said direction of conveyance of said plurality of feeder devices and approximately perpendicular to said direction of conveyance of said collating conveyors;

said lowermost portion of said folded printed products is fed by means of said plurality of feeder devices gripping said open edge to said clamping members with an open edge opposite to said folded edge leading; and said lowermost portion leading said further portion of said folded printed products.

15. The apparatus as defined in claim 7, wherein:

each collating conveyor of said plurality of collating conveyors comprises a rotatingly driven conveyor element having an axis of rotation and rotatable thereabout;

means for rotatingly driving each said rotatingly driven conveyor element; and each said rotatingly driven conveyor element comprising a support element upon which said folded printed products are deposited.

16. The apparatus as defined in claim 15, wherein:

said rotatingly driving means constituting at least part of said drive means for said plurality of collating conveyors.

17. The apparatus as defined in claim 15, wherein:

each said rotatingly driven conveyor element comprises a conveyor chain.

18. The apparatus as defined in claim 15, wherein:

each said rotatingly driven conveyor element is provided with entrainment means capable of engaging trailing edges of said folded printed products.

19. The apparatus as defined in claim 15, wherein:

said rotatingly driving means includes means for driving each said rotatingly driven conveyor element of said collating conveyors in said direction of conveyance by means of a rotational movement of each said rotatingly driven conveyor element.

20. The apparatus as defined in claim 15, wherein:

said rotatingly driving means includes means for driving each said rotatingly driven conveyor element of said collating conveyors in said direction of conveyance by means of a rotational movement of each said rotatingly driven conveyor element;

said rotatingly driving means including a plurality of sprocket wheels for guiding each said rotatingly driven conveyor element; and said rotatingly driving means further including a gear transmission mechanism for driving said plurality of sprocket wheels by means of said rotational movement of said rotatingly driven conveyor elements.

21. The apparatus as defined in claim 7, further including:

a common mounting support having a common axis of revolution and comprising shaft means defining said common axis of revolution and two substantially parallel rotatable elements extending transverse thereto;

each said collating conveyor being mounted in said common mounting support; and said drive means including power transmission means for said shaft of said common mounting support.

22. The apparatus as defined in claim 21, wherein:

said drive means includes a drive mechanism;

a plurality of rotational axes each extending in substantially parallel spaced relationship to said common axis of revolution;

each said collating conveyor including support elements for the folded printed products and being rotatable about an associated rotational axis of said plurality of rotational axes; and said drive means being arranged for rotatingly driving each said collating conveyor during revolution about said common axis of revolution such that said support elements for said folded printed products remain on an upper side of each said collating conveyor by rotation about respective ones of said rotational axes.

23. The apparatus as defined in claim 21, wherein:

said drive means includes a drive element;

each said collating conveyor comprising at least one stub shaft possessing at least one guide element;

said drive element connecting said at least one guide element to an associated one of said guide elements of an adjacent one of said collating conveyors;

said drive means including a further guide element located on said stub shaft of at least one said collating conveyor;

a further drive element guided over said further drive element; and a coaxial guide element driven by said further guide element.

24. The apparatus as defined in claim 23, wherein:

each collating conveyor of said plurality of collating conveyors comprises a rotatingly driven conveyor element; and said drive element and said further drive elements comprising drive chains.

25. An apparatus for collating folded printed products, especially signatures comprising:

a plurality of collating conveyors for conveying the folded printed products along a predetermined conveyor path in straddling relationship;

each collating conveyor of said plurality of collating conveyors having a respective axis of rotation and each said collating conveyor extending in spaced relationship to a common axis of revolution; and drive means for simultaneously driving said plurality of collating conveyors in rotation about their axes of rotation, for driving said plurality of collating conveyors in revolution about said common axis of revolution and for driving said plurality of collating conveyors in a predetermined direction of conveyance for transporting said folded printed products in said predetermined direction of conveyance.

* * * * *

US004684116B1

REEXAMINATION CERTIFICATE (1994th)

United States Patent [19]

Hänsch

[11] B1 4,684,116

[45] Certificate Issued May 4, 1993

[54] **METHOD AND APPARATUS FOR COLLATING FOLDED PRINTED SIGNATURES USING CONVEYORS [ROTATING] *REVOLVING* ABOUT A CENTRAL AXIS**

[75] Inventor: Egon Hänsch, Wetzikon, Switzerland

[73] Assignee: Ferag AG, Hinwil, Switzerland

Reexamination Request:
No. 90/002,788, Jul. 15, 1992

Reexamination Certificate for:

| | |
|---|---|
| Patent No.: | **4,684,116** |
| Issued: | **Aug. 4, 1987** |
| Appl. No.: | **877,359** |
| Filed: | **Jun. 23, 1986** |

[30] Foreign Application Priority Data

Jul. 1, 1985 [CH] Switzerland ..... 2828/85

[51] Int. Cl.[5] ..... B65H 39/02

[52] U.S. Cl. ..... 270/54; 271/9; 271/69; 271/204; 271/277; 198/644; 198/408; 198/456; 198/458; 270/55

[58] Field of Search ..... 270/53-58; 271/9, 69, 182, 270, 271, 277, 202, 204, 206, 295; 198/418.3, 418.6, 418.9, 619, 644, 570, 408, 456, 458

[56] References Cited

U.S. PATENT DOCUMENTS

| | | | |
|---|---|---|---|
| 2,626,074 | 1/1953 | Vogt | 270/55 |
| 2,969,981 | 1/1961 | Faeber | 270/54 |
| 3,096,089 | 7/1963 | Swenker et al. | 271/295 |
| 3,199,862 | 8/1965 | Muller . | |
| 3,481,594 | 12/1969 | McCain et al. | 270/54 |
| 3,540,721 | 11/1970 | Blowsky | 270/58 |
| 3,825,246 | 7/1974 | Elia et al. | 271/295 |
| 3,951,399 | 4/1976 | Reist . | |
| 4,058,202 | 11/1977 | Reist et al. | 270/55 |
| 4,398,710 | 8/1983 | Hänsch | 270/55 |
| 4,408,755 | 10/1983 | Meier | 270/52 |
| 4,416,448 | 11/1983 | Meier . | |
| 4,489,930 | 12/1984 | Meier . | |
| 4,641,825 | 2/1987 | Mowry et al. . | |

FOREIGN PATENT DOCUMENTS

| | | | |
|---|---|---|---|
| 2447336 | 10/1974 | Fed. Rep. of Germany | 270/58 |
| 2512017 | 3/1975 | Fed. Rep. of Germany | 270/55 |
| 417647 | 7/1966 | Switzerland . | |
| 2072631 | 10/1981 | United Kingdom | 270/54 |

OTHER PUBLICATIONS

Webster's Ninth New Collegiate Dictionary 1985 ® by Merriam Webster Inc. p. 1010.

*Primary Examiner*—Eugene H. Eickholt

[57] ABSTRACT

Collation of folded printed signatures or sheets is accomplished by a rotating collating cylinder or rotary collator which is rotatably driven about its longitudinal axis of revolution. The rotary collator comprises a plurality of collating conveyors arranged substantially parallel to this longitudinal axis. These collating conveyors are substantially annularly positioned about this longitudinal axis and extend substantially parallel to the longitudinal axis of the rotary collator. The folded printed signatures or sheets are fed or conveyed by three feeding conveyors or infeed devices and are deposited to straddle the collating conveyors or the respective folded printed signatures or sheets already straddling the collating conveyors. The folded printed signatures or sheets are displaced in the direction of conveyance of the rotary collator while revolving about the longitudinal axis of the rotary collator. The printed signatures or sheets are thus conveyed along a path which has the shape of a helix or coiled spiral. The end products are gripped at a product withdrawal location by a withdrawal conveyor or device and conveyed to a different location.

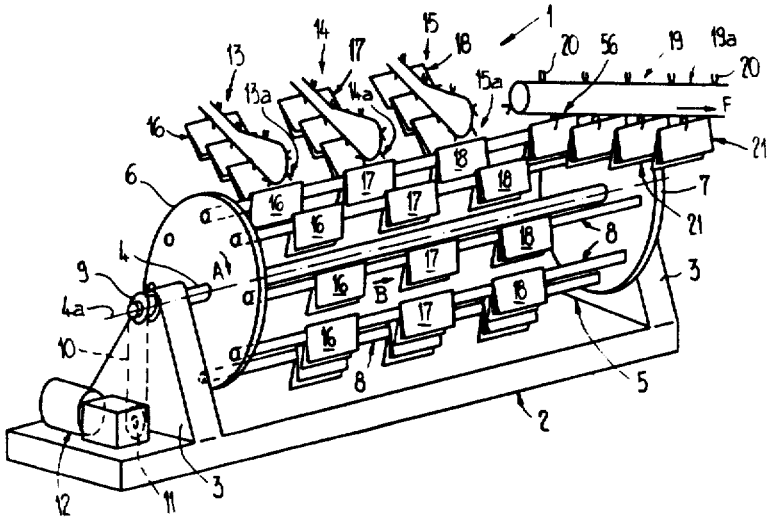

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 39–52:

Now in order to implement these and still further objects of the invention, which will become more readily apparent as the description proceeds, the method of the present invention for collating folded printed products, especially signatures or sheets, is manifested by the features that a plurality of collating conveyors are provided which are substantially parallel to a common axis of revolution and which collating conveyors are positioned around this axis of resolution. The folded printed signatures or sheets [rotate] *revolve* about this axis of revolution during their conveyance along the associated collating conveyor.

Column 4, lines 32–45:

As shown in FIGS. 1 and 4, a sprocket or sprocket wheel 9 is mounted on one end of the shaft 4. Substantially below this sprocket or sprocket wheel 9 there is situated a drive means 12 positioned on the base of the frame or stand 2 on a not particularly referenced drive shaft of this drive means 12 there is mounted a further sprocket or sprocket wheel 11 which is also positioned substantially below the sprocket or sprocket wheel 9. A chain 10 engages and travels around the periphery of these sprockets or sprocket wheels 9 and 11. [The collating drum or cylinder 5 together with the collating conveyors 8 is rotationally or circularly, i.e., revolvingly, driven by means of the drive means 12 in the direction of the arrow A about an axis of revolution 4a.] *The collating drum or cylinder 5 is rotationally or circularly driven in the direction of the arrow A while the collating conveyors are revolvingly driven, both by means of the drive means 12 about the axis 4a.*

AS A RESULT OF REEXAMINATION, IT HAS BEEN DETERMINED THAT:

The patentability of claim 25 is confirmed.

Claims 1, 5, 7, 15, 22 are determined to be patentable as amended.

Claims 2–4, 6, 8–14, 16–21, 23–24, dependent on an amended claim, are determined to be patentable.

1. A method for collating folded printed products, especially signatures, comprising the steps of:

conveying the folded printed products in an advancing conveying movement and in straddlingly superimposed relationship along a plurality of substantially straight and substantially parallel conveyor paths positioned radially around a common axis of revolution, *each of said conveyor paths having a respective axis of rotation*; and revolving said plurality of substantially straight and substantially parallel conveyor paths about said common axis of revolution together with said folded printed products *while rotating said conveyor paths about the respective rotational axes* during said advancing conveying movement along respective conveyor paths of said plurality of substantially straight and substantially parallel conveyor paths.

5. A method for collating folded printed products, especially signatures, comprising the steps of:

conveying the folded printed products in an advancing conveying movement and in straddlingly superimposed relationship along a plurality of conveyor paths positioned radially around a common axis of revolution, *each of said conveyor paths having a respective axis of rotation*; and revolving said plurality of conveyor paths about said common axis of revolution together with said folded printed products *while rotating said conveyor paths about the respective rotational axes* during said advancing conveying movement along respective conveyor paths of said plurality of conveyor paths.

7. An apparatus for collating folded printed products, especially signatures, comprising:

a plurality of collating conveyors for conveying the folded printed products along a respective substantially straight conveyor path in straddling relationship;

each collating conveyor of said plurality of collating conveyors extending in spaced substantially parallel relationship to a common axis of revolution, *each of said collating conveyors having a respective axis of rotation*; and drive means for driving said plurality of collating conveyors in revolution about said common axis of revolution *while rotating said conveyor paths about the respective rotational axes.*

15. The apparatus as defined in claim 7, wherein:

each collating conveyor of said plurality of collating conveyors comprises a rotatingly driven conveyor element having [an] *the respective* axis of rotation and rotatable thereabout;

*said drive means comprising* means for rotatingly driving each said rotatingly driven conveyor element; and each said rotatingly driven conveyor element comprising a support element upon which said folded printed products are deposited.

22. The apparatus as defined in claim 21, wherein:

said drive means includes a drive mechanism;

[a plurality of] *said* rotational axes each extending in substantially parallel spaced relationship to said common axis of revolution;

each said collating conveyor including support elements for the folded printed products [and being] rotatable about an associated rotational axis of said plurality of rotational axes; and said drive means being arranged for rotatingly driving each said collating conveyor during revolution about said common axis of revolution such that said support elements for said folded printed products remain on an upper side of each said collating conveyor by rotation about respective ones of said rotational axes.

* * * * *